US009180661B2

(12) United States Patent
Hayes, III et al.

(10) Patent No.: US 9,180,661 B2
(45) Date of Patent: Nov. 10, 2015

(54) APPARATUS, SYSTEM, AND METHOD FOR COMPENSATING LIGHT EMITTING DIODES

(71) Applicant: Xerox Corporation, Norwalk, CT (US)

(72) Inventors: Frederick O. Hayes, III, Ontario, NY (US); Paul A. Hosier, III, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/201,239

(22) Filed: Mar. 7, 2014

(65) Prior Publication Data

US 2015/0251413 A1 Sep. 10, 2015

(51) Int. Cl.
*B41J 2/45* (2006.01)
*B41J 2/045* (2006.01)
*H05B 33/08* (2006.01)

(52) U.S. Cl.
CPC ..... *B41J 2/04541* (2013.01); *H05B 33/0851* (2013.01)

(58) Field of Classification Search
USPC ..... 347/9
See application file for complete search history.

(56) References Cited

U.S. PATENT DOCUMENTS

2007/0013925 A1* 1/2007 Ishikawa ..... 358/1.7
2010/0026214 A1* 2/2010 Nagumo ..... 315/313

* cited by examiner

*Primary Examiner* — Stephen Meier
*Assistant Examiner* — Alexander D Shenderov
(74) *Attorney, Agent, or Firm* — Simpson & Simpson, PLLC

(57) ABSTRACT

A semi-conductor chip for a print head, including: a plurality of LEDs; a drive circuit for supplying electrical power to the plurality of LEDs; and a control system calibrated to supply, using the drive circuit, the electrical power at a first magnitude to every LED in the plurality of LEDs and configured to: receive a first external clock pulse less than a second external clock pulse used to calibrate the plurality of LEDs; change the first magnitude to at least one second magnitude proportional to the first external clock pulse; receive a third external clock pulse different from the first and second external clock pulses; and energize, using the drive circuit and in response to the third external clock pulse, the plurality of LEDs for a first internal strobe time at the at least one second magnitude calculated by the control system.

20 Claims, 12 Drawing Sheets

APPARATUS, SYSTEM, AND METHOD FOR COMPENSATING LIGHT EMITTING DIODES

TECHNICAL FIELD

The present disclosure relates to an apparatus, system, and method for compensating light emitting diodes (LEDs), in particular LEDs on semi-conductor chips for a print head. The apparatus, system, and method vary electrical power applied to LEDs to compensate for variation in internal performance of LEDs and LED drive circuits, for example as exemplified by differences in rise and fall times for LEDs and according to pulse times used to energize the LEDs.

BACKGROUND

FIG. 1 illustrates drive circuits and light emitting diodes (LEDs) for prior art LED print-head (LPH) 10. FIG. 2 is a detail showing two semi-conductor chips from FIG. 1. In the example of FIG. 1, there are 40 semi-conductor chips 12 on LPH 10 and each chip includes 384 LEDs 14 forming LED array 16 of 15,360 LEDs 14. As the yield and efficiency of LED technology has improved, LPH imagers have been developed and used for xerographic printing applications, for example, in higher performance and higher quality applications. Each LED 14 is connected to a respective drive circuit 18.

FIG. 3 is a pictorial representation of portions of LPH 10 in FIG. 1. For yield reasons, optical performance and compactness, full width LPHs, i.e., LPHs spanning the entire cross process direction, are often made as multi-chip assemblies carefully assembled and focused in a housing with a SELFOC® lens, i.e., a gradient index lens or GRIN lens, as shown in FIG. 4. For clarity, the housing has been omitted in FIG. 4. SELFOC® lens 22 is arranged between multi-chip LED array assembly 16 and photoreceptor drum 24. It should be appreciated that although a photoreceptor drum is depicted in FIG. 4, other photosensitive surfaces may also be used in the foregoing arrangement, e.g., a photoreceptor belt. During xerographic printing, LED light 26 from array assembly 16 is focused on drum 24 via lens 28. The "self-focusing" property of SELFOC® lenses is well known in the art and therefore not further described herein.

FIG. 4 is a representation of clocks and a data line for LPH 10 in FIG. 1. Variation of internal performance of LEDs and LED driving circuits on each of the chips in a multi-chip LPH, which results in undesired variation of optical output for the chips, is a source of imperfect imaging for an LPH. Typically, variations of LED optical power output is corrected by per LED and/or per chip power correction in relatively small steps of optical power output, for example of 1 to 5%. Electrical power, in particular electrical current, available for energizing the LEDs is available in steps corresponding to the optical power output steps. During operation in an LPH, LEDs are energized over a range of strobe times. The strobe time is the "on" time of the LEDs during each output line time and is shown as TWSTBi in FIG. 4.

Typically, the correction, or calibration, is performed at a strobe time (calibration strobe time) that is the maximum value in the range by applying power at one of the power steps until the optical power output falls within a desired range, for example +/−2%. The electrical power, in particular, the electrical current, used for the calibration is then used for normal operation of the LEDs and LPH.

FIG. 5 is a graph depicting LED percent optical power output variation from average LPH LED optical power output for chips 12A and 12B for LPH 10 in FIG. 1 at a calibration (long) strobe time. Note that chips 12A and 12B can be located in any configuration with respect to each other in FIG. 1. FIG. 6 is a graph depicting LED percent optical power output variation from average LPH LED optical power output for the chips in FIG. 5 at a short strobe time, for example 1 microsecond (uS). Although the LPH output power can be corrected to a very good uniformity of illumination within a chip and between chips at the calibration strobe time, as shown in FIG. 5, this uniformity can degrade at different strobe times, in particular, for strobe times less than the calibration strobe time, as shown in FIG. 6. As shown in FIG. 6 there is a noticeable offset between LEDs for the first chip (left-hand side of plot) and the second chip (right-hand side of plot). This offset can result in band effects visible to the naked eye.

Returning to FIG. 4, a single master clock CLKM is used for LPH 10 and hence for all the chips on LPH 10. LED strobe CLKS is the same for every chip in LPH 10. CLKS goes high and low according to rising or falling edges of master clock CLKM, for example, edges E1 and E2, respectively. LEDs are energized and de-energized via drive circuits 18 in response to the rise and fall of CLKS, respectively. Rise time TDR on internal strobe clock CLKSI is the time span needed for CLKSI to go high (optical power output to reach a maximum) in response to CLKSI and fall time TDF is the time span needed for CLKSI to go low (zero optical power output) in response CLKSI. TDR and TDF are due to delays inherent in the circuitry of driver circuits 18 and the internal characteristics of the various LEDs 14.

If TDR and TDF of respective LED driver circuits 18 are the same, strobe time on CLKSI is equal to TWSTB on CLKS. However, if the respective TDRs and TDFs vary from chip 12 to chip 12, and do not vary an equal amount, TWSTBi strobe time can vary from chip to chip. Since the LED power is calibrated to be uniform at a given TWSTB, the calibration will not produce uniform output at all TWSTB times.

To illustrate the magnitude of uncalibrated error, take the case of maximum strobe time of 30 uS. If the TDF-TDR variation across chips in LPH 10 is +/−0.1 uS, this results in a +9.6/−9.7% chip average power variation at a TWSTB time of 1 uS since the TWSTBi time would vary by +/−0.1 uS. Even for a TDF-TDR variation of +/−0.05 uS results in a range of chip powers of +/−5%. Depending on operating exposure and xerographic transfer curve, this amount of 5% power variation may only result in less than 1-2% density variation in critical halftone densities. However, since this chip wide density band variations are very noticeable, anything greater than 0.5% or lower may not be acceptable for mid to high quality printers.

It is known to address the imaging uniformity problem describe above by specifying a minimum TWSTB time allowed during operation of the LPH, for example, one which will limit the maximum chip uniformity to some acceptable value. This solution is not ideal since 1) it still enables some level of chip wide streaks in printing even at TWSTB times at or above minimum, 2) it does not enable the very low TWSTB times needed if printing at slow speeds where lower exposure is needed for xerographic control, 3) the minimum specified time may not be sufficient for high quality printers.

SUMMARY

According to aspects illustrated herein, there is provided a method of compensating power output for light emitting diodes (LEDs), comprising: receiving, in a first semi-conductor chip, a first external clock pulse less than a second external clock pulse used to calibrate a first plurality of LEDs for the first semi-conductor chip; applying the first external clock pulse to at least one first drive circuit for the first semi-conductor chip; energizing, using the at least one first drive circuit and in response to the first external clock pulse, the first plurality of LEDs for a first internal strobe time and at a first power level used to calibrate the first plurality of LEDs; measuring a first value for a first optical power output of the first plurality of LEDs; applying the first external clock pulse to at least one second drive circuit for a second semi-conductor chip; energizing, using at least one second drive circuit for the second semi-conductor chip and in response to the first external clock pulse, a second plurality of LEDs for the second semi-conductor chip for a second internal strobe time at the first power level; measuring a second value for a second optical power output of the second plurality of LEDs; calculating, using a control system for the first chip and the first and second values, an offset proportional to a difference between the first and second values, or storing in a memory element for the first chip an offset proportional to a difference between the first and second values; increasing or decreasing, using the control system, the first power level to at least one second power level according to the offset; receiving, in the first semi-conductor chip, a third external clock pulse different from the first and second external clock pulses; and energizing, using the at least one first drive circuit and in response to the third external clock pulse, the first plurality of LEDs for a third internal strobe time at the at least one second power level calculated by the control system.

According to aspects illustrated herein, there is provided a semi-conductor chip for a print head for a device useful in digital printing, including: a first plurality of light emitting diodes (LEDs); at least one drive circuit for supplying electrical power to the first plurality of LEDs; a memory element configured to store an offset; and a control system calibrated to supply, using the at least one drive circuit, the electrical power at a first magnitude to every LED included in the first plurality of LEDs and configured to: receive an external clock pulse; change using the offset, the first magnitude to at least one second magnitude; and energize, using the at least one first drive circuit and in response to the external clock pulse, the first plurality of LEDs for an internal strobe time at the at least one second magnitude.

According to aspects illustrated herein, there is provided a semi-conductor chip for a print head for a device useful in digital printing, including: a first plurality of light emitting diodes (LEDs); at least one drive circuit for supplying electrical power to the first plurality of LEDs; and a control system calibrated to supply, using the at least one drive circuit, the electrical power at a first magnitude to every LED included in the first plurality of LEDs and configured to: receive a first external clock pulse less than a second external clock pulse used to calibrate a first plurality of LEDs for the first semi-conductor chip; change the first magnitude to at least one second magnitude proportional to the first external clock pulse; receive a third external clock pulse different from the first and second external clock pulses; and energize, using the at least one first drive circuit and in response to the third external clock pulse, the first plurality of LEDs for a first internal strobe time at the at least one second magnitude calculated by the control system.

According to aspects illustrated herein, there is provided a print head for a device useful in digital printing, including: a first semi-conductor chip including a first plurality of light emitting diodes (LEDs) and at least one first drive circuit for supplying electrical power to the first plurality of LEDs; a second semi-conductor chip including a second plurality of LEDs and at least one second drive circuit for supplying electrical power to the second plurality of LEDs; and a control system calibrated to supply, using the at least one power supply and the at least one first and second drive circuits, electrical power at a first magnitude to every LED included in the first and second pluralities of LEDs, respectively and configured to: receive a first external clock pulse less than a second external clock pulse used to calibrate a first plurality of LEDs for the first semi-conductor chip; change the first magnitude to at least one second magnitude proportional to the first external clock pulse; receive a third external clock pulse different from the first and second external clock pulses; and energize, using the at least one first drive circuit and in response to the third external clock pulse, the first plurality of LEDs for a first internal strobe time at the at least one second magnitude calculated by the control system.

According to aspects illustrated herein, there is provided a device useful in digital printing, including: a first semi-conductor chip including a first plurality of light emitting diodes (LEDs) and at least one first drive circuit for supplying electrical power to the first plurality of LEDs; a second semi-conductor chip including a second plurality of LEDs and at least one second drive circuit for supplying electrical power to the second plurality of LEDs; and at least one control system calibrated to supply, using the at least one power supply and the at least one first and second drive circuits, electrical power at a first magnitude to every LED included in the first and second pluralities of LEDs, respectively and configured to: determine an external clock pulse during which to supply electrical to the first and second pluralities of LEDs at the first magnitude to produce a print output; change the first magnitude to at least one second magnitude proportional to the external clock pulse; and energize, using the at least one first and second drive circuits and in response to the external clock pulse, at least respective portions of the first and second pluralities of LEDs for an internal strobe time at the at least one second magnitude.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Regarding the term "device useful for digital printing", it should be understood that digital printing broadly encompasses creating a printed output using a processor, software, and digital-based image files. It should be further understood that xerography, for example using light-emitting diodes (LEDs), is a form of digital printing.

Furthermore, as used herein, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, a server, one or more personal computers, a standalone scanner, a mobile phone, an MP3 player, audio electronics, video electronics, GPS systems, televisions, recording and/or reproducing media or any other type of consumer or non-consumer analog and/or digital electronics.

Moreover, although any methods, devices or materials similar or equivalent to those described herein can be used in the practice or testing of these embodiments, some embodiments of methods, devices, and materials are now described.

Figure 7:
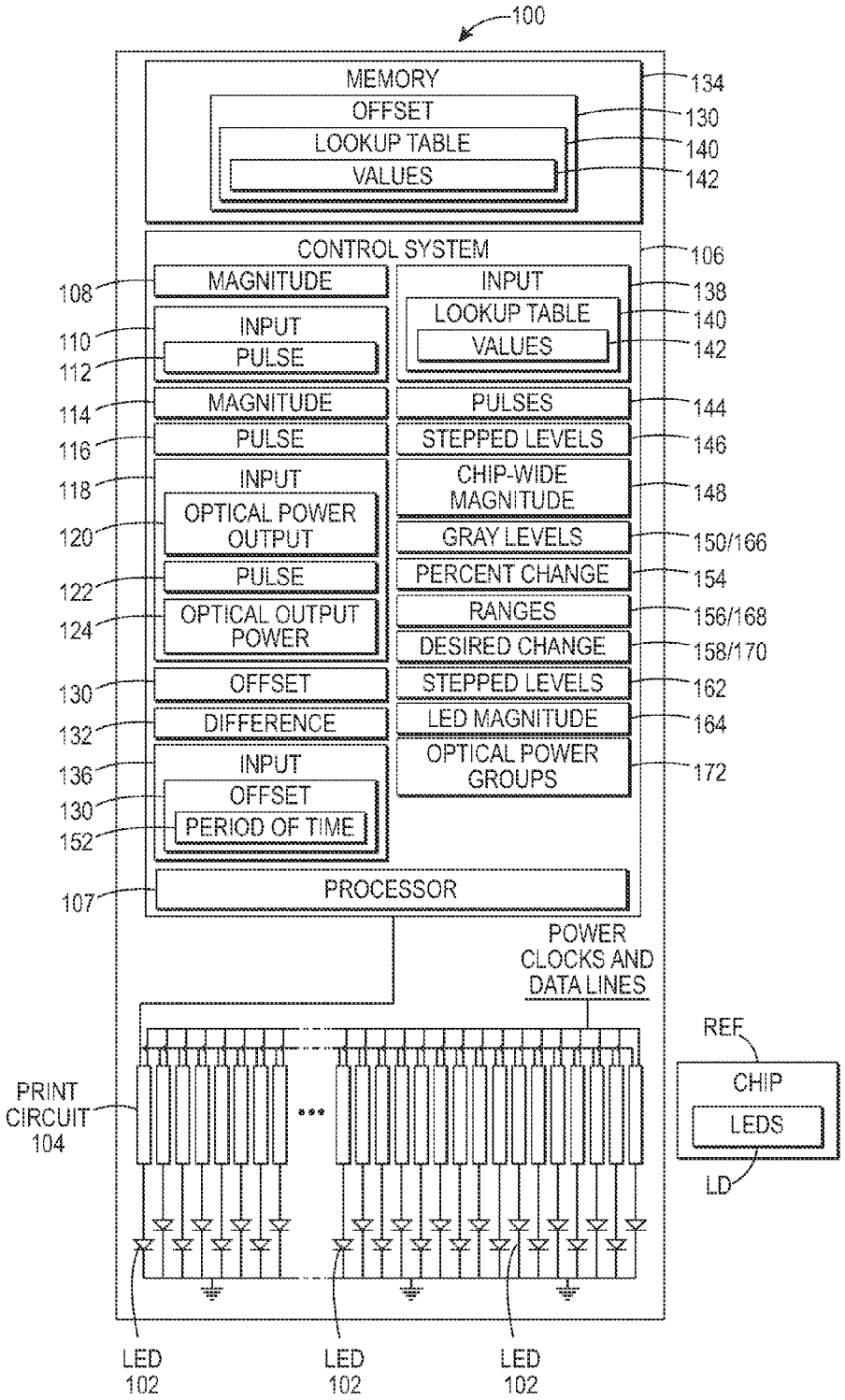
FIG. 7 is a schematic representation of a semi-conductor chip, for a device useful for digital printing, with power compensation.

FIG. 7 is a schematic representation of semi-conductor chip 100, for a device useful for digital printing, with power compensation. Chip 100 includes light emitting diodes (LEDs) 102, at least one drive circuit 104 for supplying electrical power to LEDs 102, and control system 106. In FIG. 7, each LED 102 has a separate circuit 104. However, it should be understood that more than one LED can be connected to a single circuit 104. That is, LEDs 102 can be formed into a plurality of groups of LEDs, each group including multiple LEDs connected to single respective circuits 104. In an example embodiment, system 106 includes processor 107. Unless stated otherwise, LEDs 102 constitute all the LEDs on chip 100. In FIG. 7, chip 100 includes 384 LEDs 102 and drive circuit 104; however, it should be understood that other numbers of LEDs are possible.

Control system 106 is calibrated to supply, as is known in the art and using drive circuits 104, electrical power at magnitude 108 to every LED 102. Control system 106 is configured to receive input 110 identifying external clock pulse 112 during which electrical power is to be supplied to LEDs 102, for example to execute a printing operation. Control system 106 is configured to change magnitude 108 to at least one magnitude 114 proportional to clock pulse 112, and to energize, at magnitude 114 and in response to clock pulse 112, at least a portion of LEDs 102 using drive circuits 104. As noted above, the actual time that LEDs are energized, hereinafter referred to as an internal strobe time typically varies from pulse 112. For example, pulse 112 is analogous to TWSTB and the internal strobe time is analogous to TWSTBi described above.

As further described below, the at least one magnitude 114 is calculated to compensate the optical output power of LEDs 102. As further described below, the compensation is at least partially related to differences in circuits 104, for example as exhibited by differences in assumed and actual rise and fall times for LEDs 102 and power drops associated with lines providing power to LEDs 102.

In an example embodiment, LEDs 102 are calibrated by supplying electrical power at magnitude 108 for external clock pulse 116 as is known in the art. Control system 106 is configured to receive input 118 including optical power output 120 for LEDs 102 for electrical power applied at magnitude 108 to circuits 104 for clock pulse 122 and optical output power 124 for reference chip REF having a same number of LEDs as chip 100, for electrical power applied at magnitude 108 and for clock pulse 122. In an example embodiment, pulse 122 is different from pulses 112 and 116. In an example embodiment, pulse 122 is at the low end of possible external clock pulses. Control system 106 is configured to calculate offset 130 proportional to clock pulse 122 and difference 132 between optical power outputs 120 and 124, and, calculate the at least one magnitude 114 using offset 130.

In an example embodiment, chip 100 includes memory element 134 and control system 106 is configured to received input 136 including offset 130 and store offset 130 in memory 134. In an example embodiment, chip 100 includes memory element 134 and control system 106 is configured to receive input 138 including lookup table 140 and store table 140 in memory 134. Table 140 includes compensating values 142 associated with respective external clock pulses 144 during which LEDs 102 can be energized. For example clock pulses 144 include the range of clock pulses during which LEDs 102 can be energized to execute printing operations. Control system 106 is configured to calculate magnitude 114 using a respective compensating value 142 associated with for clock pulse 112.

Powers 120 and 124 can be determined by measuring optical output power for chips 100 and REF at strobe time 122 using any means known in the art, or by comparing print density for chips 100 and REF at clock pulse 122.

Figure 6:
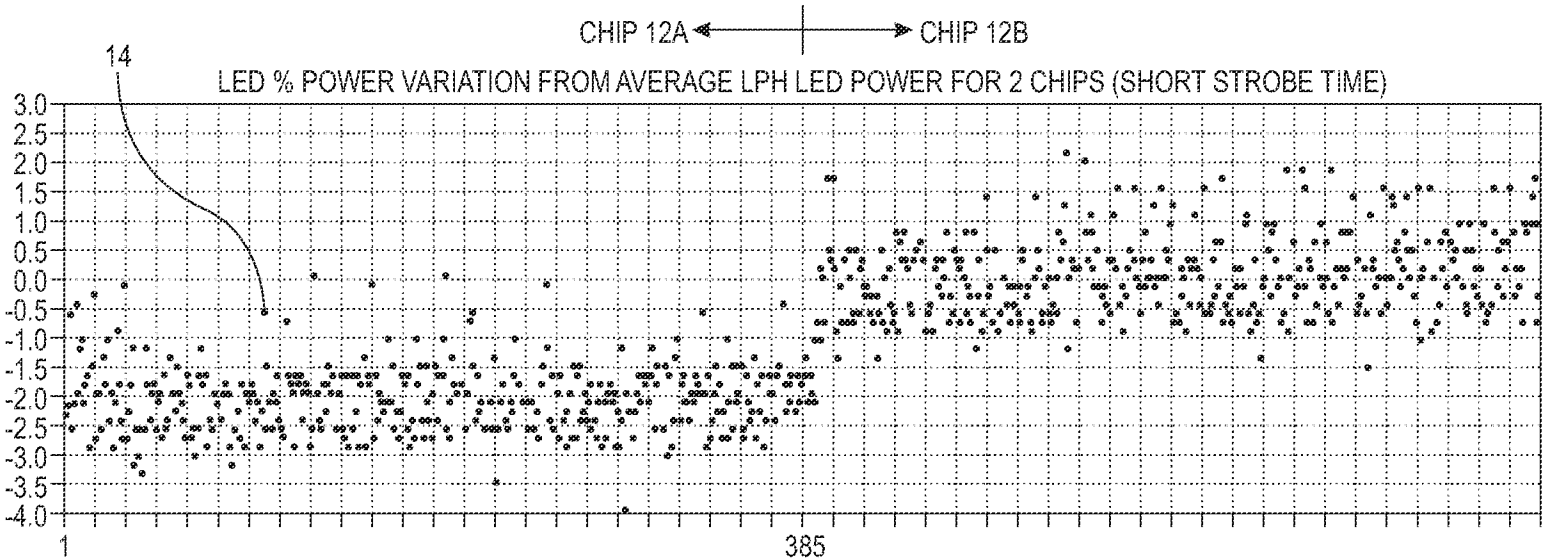
FIG. 6 PRIOR ART
FIG. 6 is a graph depicting LED percent optical power output variation from average LPH LED optical power output for the two chips in FIG. 5 at a short strobe time, for example 1 microsecond.

As shown in FIG. 6, the calibration performed on a chip such as chip 12A or chip 100 light output degrades at a short strobe time. As noted above, if respective TDRs and/or TDFs vary from drive circuit to drive circuit, and the respective TDRs and/or TDFs do not vary an equal amount, TWSTBi strobe time can vary from chip to chip. Since the LED power is calibrated to be uniform at a given TWSTB, the calibration will not produce uniform output at all TWSTB times. The output can be higher than desired or required, or lower than desired or required.

The following provides further detail regarding the calculation of offset 130. For example, CLKS (clock pulse 112) is applied for 1 microsecond (1 uS) to chips 100 and REF and optical output powers 120 and 124 for all the LEDs on chips 100 and REF, respectively, are measured or otherwise determined. The ratio of powers 120 to 124 is determined. For example, assume 120 is 90% of 124. Then, offset 130 is 10% of 1 uS (clock pulse 112) or 0.1 uS on clock CLKSI for chip 100. Thus, for a duration of 1 uS for clock pulse 112, the target is to increase the optical output power for chip 100 to equal that of chip REF In the preceding example, offset 130 is 10% of clock pulse 112, or 0.1 uS. Therefore, chip 100 is on for 0.9 uS. The general formulation for calculating compensation is: on time for compensated chip)×(amount by which to multiply power to the compensated chip)=on time for reference chip). In the present example: (0.9 uS)×(amount by which to multiply power to the compensated chip)=1 uS, which results in amount=1.11, which is an 1.11% increase in power to chip 100.

Figure 1:
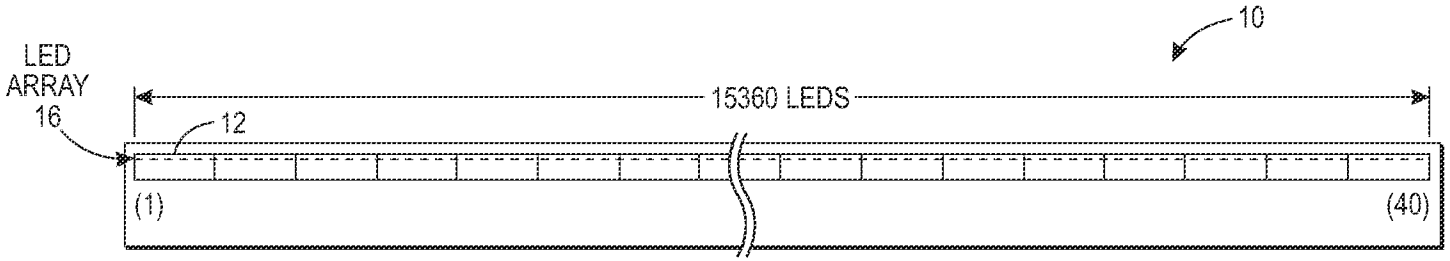
FIG. 1 illustrates drive circuits and light emitting diodes (LEDs) for a prior art LED print-head (LPH)
Figure 2:
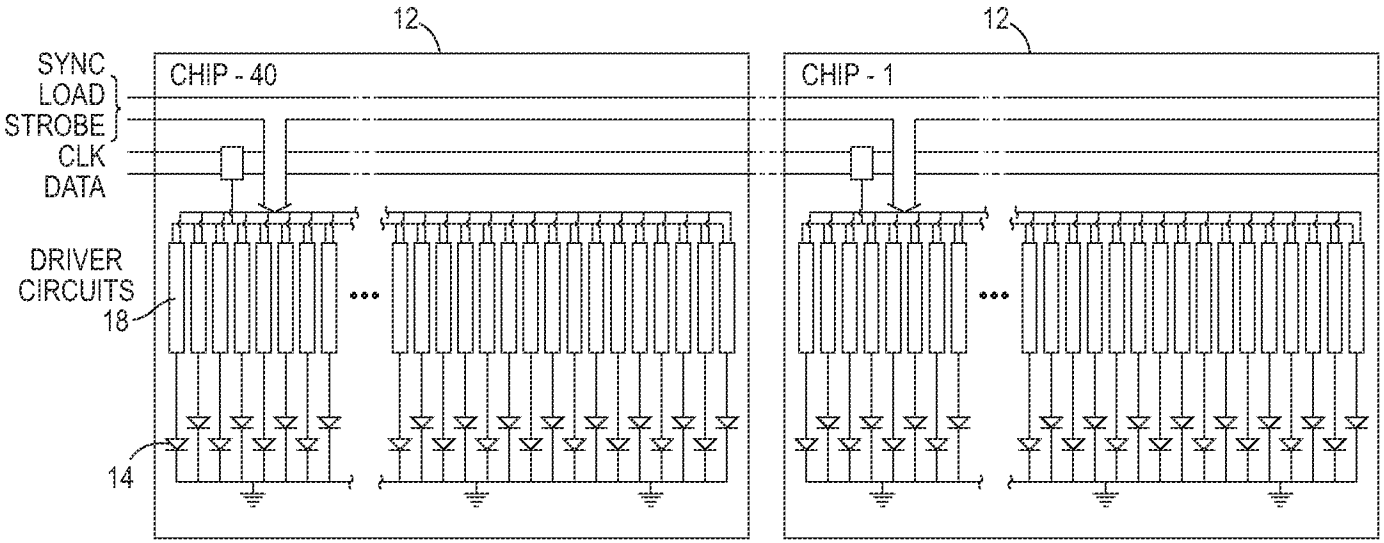
FIG. 2 PRIOR ART
FIG. 2 is a detail showing two semi-conductor chips from FIG. 1.
Figure 3:
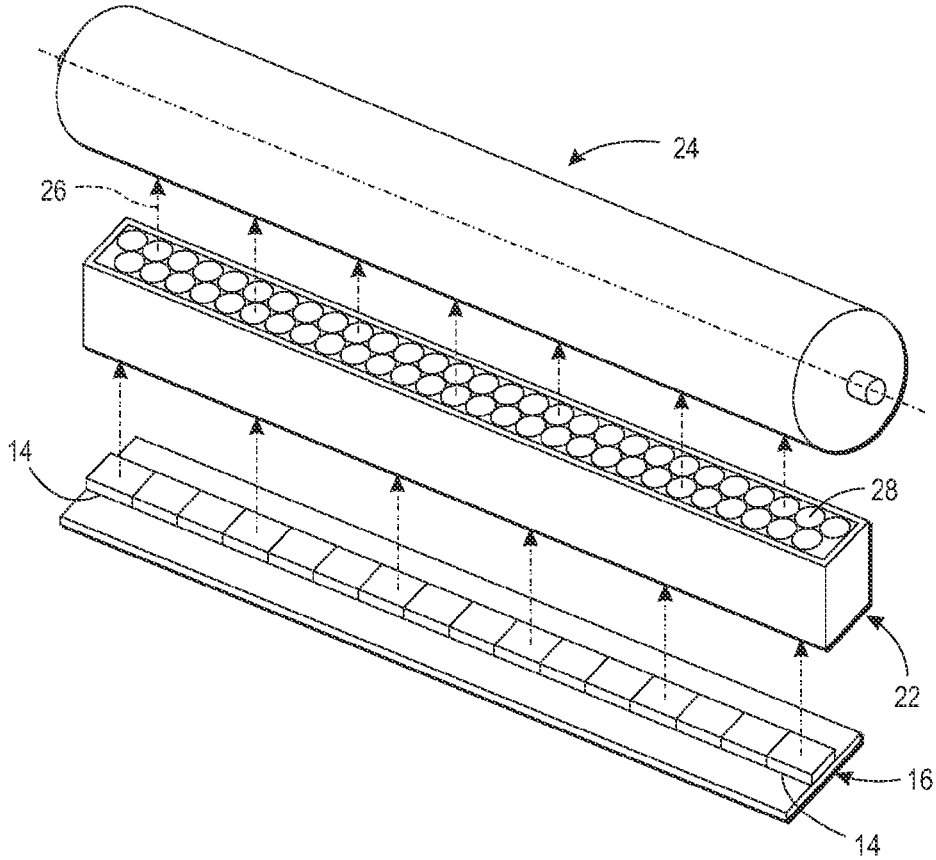
FIG. 3 is a pictorial representation of portions of the LPH in FIG. 1.
Figure 4:
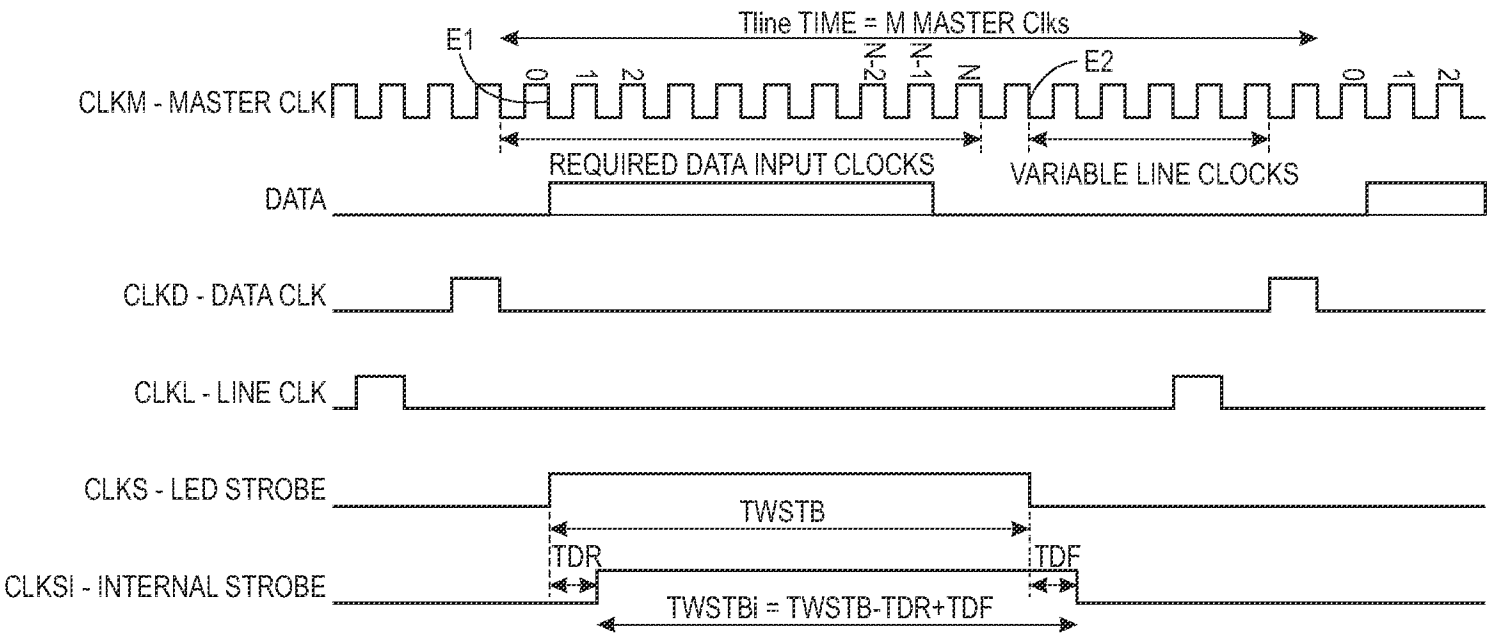
FIG. 4 PRIOR ART
FIG. 4 is a representation of clocks and a data line for the LPH in FIG. 1.
Figure 5:
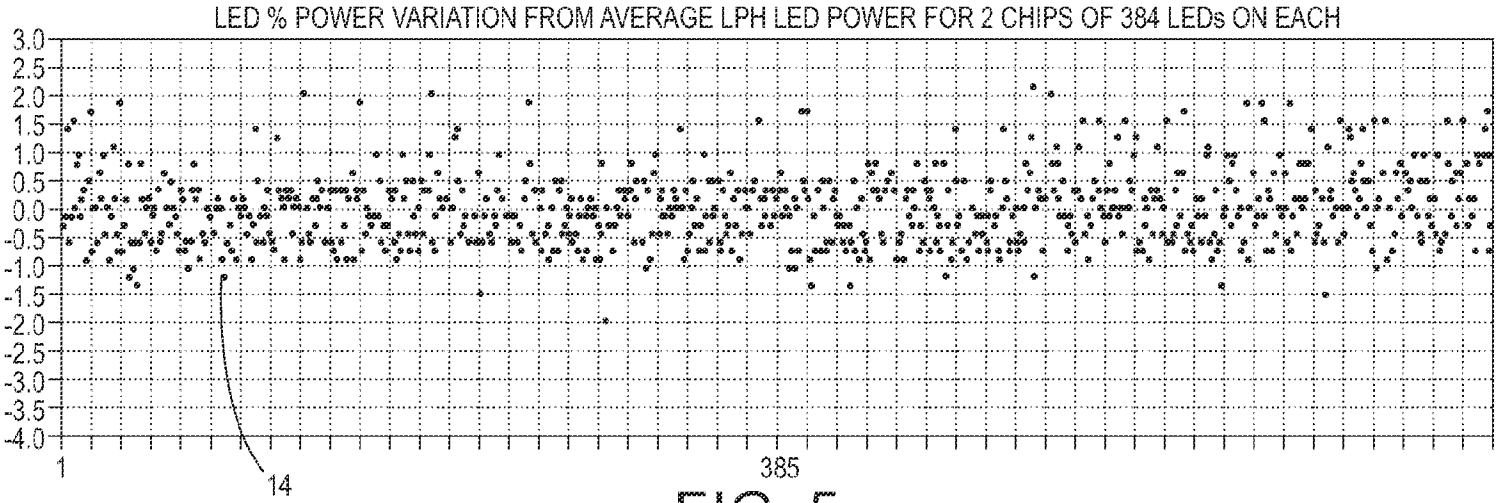
FIG. 5 PRIOR ART
FIG. 5 is a graph depicting LED percent optical power output variation from average LPH LED optical power output for two chips for the LPH in FIG. 1 at a calibration strobe time.

Offset 130 is constant for the full range of clock CLKS. For example, as described above with respect to FIG. 4, the offset is established by TDR or TDF, and TDR and TDF are constant. That is, as explained for FIG. 4, TDR and TDF are due to delays inherent in the circuitry of driver circuits 18 and the internal characteristics of the various LEDs 14, and are not a function of the on time for a chip (clock CLKS). Therefore, in the present example, offset 130 can be used to compensate chip 100 for the full range of clock CLKS. For example, for a duration of 10 uS on clock CLKS, the offset is still 0.1 uS, and chip 100 is on for 9.99 uS. Using the general formulation above, the compensation is calculated as follows: (9.99 uS)× (amount by which to multiply power to chip 100)=10 uS. Amount=10/9.99=1.001=1.001% power increase. Typically, the required compensation decreases as clock CLKS increases.

Control system 106 is configured to simultaneously energize, using drive circuit 104, LEDs 102 at stepped, or digital, levels 146 of electrical power, as is known in the art. That is, electrical power input and optical power output of LEDs 102 is executed on a chip-wide basis. These stepped levels are related to digital to analog converters (not shown) which receive a digital input and provide an analog current to LEDs 102. In general, to energize LEDs 102, voltage is held constant and current is varied (increased or decreased) within each voltage level 146. In an example embodiment, control system 106 is configured to create chip-wide magnitude 148 by changing magnitude 108 by at least one stepped level 146 and supply, using circuits 104, electrical power input to all of LEDs 102 at magnitude 148.

An increase or decrease of input power to chip 100 by one level 146 produces an increase or decrease, respectively, of optical output power for chip 100 by one chip-wide gray level 150. Thus, since changes to input power at the chip-wide level are only possible by levels 146, changes to the optical output power at the chip-wide level are implemented in chip-wide gray levels.

In an example embodiment, offset 130 is proportional to clock pulse 112 and the offset is period of time 152. As further described below, control system 106 is configured to calculate desired percent change 154 in optical output power for LEDs 102 as a percentage of the period of time 152 with respect to clock pulse 112.

Thus, each respective level 146 is associated with a gray level 150, which is a percentage change in optical output power for chip 100. Control system 106 is configured to select gray level(s) 150 within range 156 of desired percentage change 158 and create magnitude 114 by increasing or decreasing power level 108 by an amount equal to the selected stepped value 146. For example, range 156 can be a fraction of a gray level 150 so that compensation approaches, but does not surpass change 158.

Figure 8:
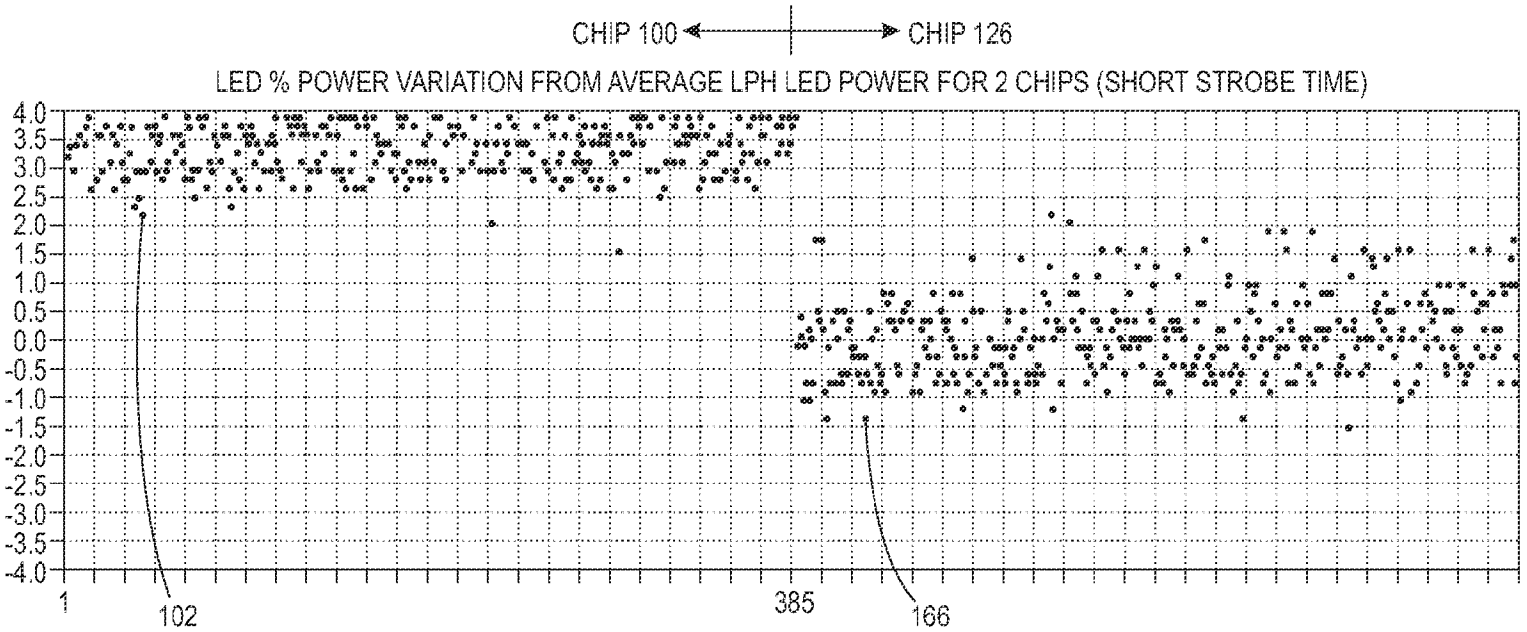
FIG. 8 is a graph depicting LED percent optical power output variation from average LPH LED optical power output for the chip in FIG. 7 with power compensation applied at a chip-wide level.

FIG. 8 is a graph depicting LED percent optical power output variation from average LPH LED optical power output for chip 100 with power compensation applied at a chip-wide level. FIG. 8 assumes that: LEDs 102 and LD for chip 100 and reference chip REF, respectively, are as shown for LEDs 14 for chips 12A and 12B, respectively in FIG. 6, prior to application of power compensation as described above for chip 100. Returning to FIG. 6, it is seen that an average optical output power difference between chips 100 and REF is about 1.5%, that is, average optical power output for chip 100 is reduced by about 1.5% compared to REF. Thus, it is desirable to increase the optical output power for the LEDs in chip 100 by about 1.5%. In the example of FIG. 8, chip-wide optical output power correction steps, or gray levels 150, are 5%, that is, optical power output for all the LEDs is boosted by 5% steps. As is shown in FIG. 8, application of a 5% step increases optical output power of chip 100 by too great a degree and results in a significant difference in optical output power between chips 100 and REF, which in turn could cause the banding problems noted above. As further described below, this issue is addressed by power compensation at the LED level.

As another example, the optical output power difference between chips 100 and REF is 5% and chip-wide correction, or gray levels 150, is in 2% steps. In this case range 156 is 1% and power input is increased by two levels 146 to increase optical output power by two gray levels 150 (4%) to bring the optical output power difference between chips 100 and REF to 1%.

In an example embodiment, control system 106 is configured to separately energize, using respective drive circuits 104, each LED 102 with stepped, or digital, levels 162 of electrical power, as is known in the art. The discussion regarding levels 146 is applicable to levels 162. Control system 106 is configured to calculate LED magnitude 164 by changing magnitude 108 by at least one stepped level 162. That is, compensation is executed on a LED by LED basis, rather than on a chip-wide basis.

An increase or decrease of input power to an LED 102 by one level 162 produces an increase or decrease, respectively, of optical output power for the LED 102 by one LED gray level 166. Thus, since changes to input power at the LED level are only possible by levels 162, changes to the output power at the LED level are implemented in gray levels 166. Note that gray levels 150 and 166 can be different from each other.

Thus, each respective level 162 is associated with a gray level 166, which is a percentage change in optical output power for an LED 102. Control system 106 is configured to select gray level(s) 166 within range 168 of desired percentage change 170 and create magnitude 114 by increasing or decreasing power level 108 by an amount equal to the selected stepped value 162.

In an example embodiment and as further described below, power input to LEDs 102 is performed on both the chip-wide level and on the individual or group LED level. For example, all LEDs 102 are energized at chip-wide magnitude 148 and some or all of LEDs 102 are additionally energized at LED magnitude 164.

Figure 9:
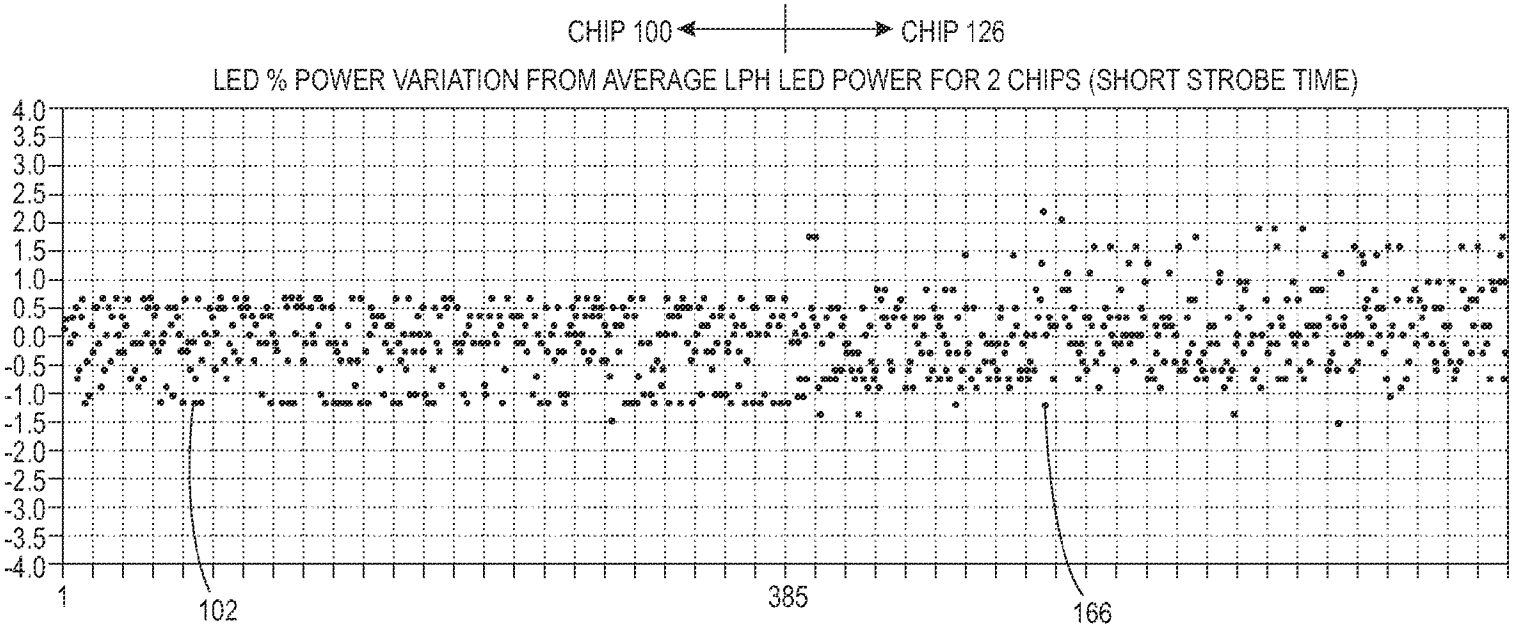
FIG. 9 is a graph depicting LED percent optical power output variation from average LPH LED optical power output for the chip in FIG. 7 with power compensation applied at an LED level.

FIG. 9 is a graph depicting LED percent optical power output variation from average LPH LED optical power output for chip 100 with power compensation applied at an LED level. FIG. 9 assumes that: LEDs 102 and LEDs LD for chip 100 and reference chip REF, respectively, are as shown for LEDs 14 for chips 12A and 12B, respectively in FIG. 6, prior to application of power compensation as described above for chip 100.

In general, power compensation and gray level options at an LED level are finer (smaller steps) than power compensation and gray level options at the chip-wide level. For example, stepped levels 162 and gray levels 166 are smaller than stepped levels 146 and gray levels 150, respectively. Returning to FIG. 6, it is seen that an average optical output power difference between chips 12A and 12B is about 1.5%. Assuming gray levels 166 are at 0.5% steps, then the LEDs on chip 100 are compensated by three gray levels to produce the results of FIG. 9, in which the respective optical output powers for chips 100 and REF are closely balanced.

As another example, the optical output power difference between chips 100 and REF is 5.5%, gray levels 150 are in 2% steps, and gray levels 166 are in 0.5% steps. Two gray levels 150 (4%) are applied and three gray levels 166 (1.5%) are applied to essentially remove the optical output power difference between chips 100 and REF.

The following provides further detail regarding the use of LED-level correction. Compensation at levels finer than LED gray levels 166 (fractions of a gray level 166) can be done by selecting appropriate groups of LEDs 102 for compensation. In an example embodiment, LEDs 102 are sorted into groups 172 according to percentage changes in optical power output, with respect to an average for chip 100, after calibration and before applying the compensation described above and below. In general, manufacturers of chip 100 test optical output power for each LED 102 and this information is available to sort LEDs 102 into groups 172 as described below.

For example, assume gray level 166 is 5% for chip 100. To provide compensation at increments less than 5%, LEDs 102 are sorted into groups associated with the desired increments. For example, to obtain an increase of 2% for the optical output power of chip 100 a group 172 associated with a 2% increase is raised by one gray level 166. The LEDs forming the 2% increase group 172 are identified as follows. 2% is 40% of 5% (gray level 166); therefore, 40% of LEDs 102 are included in the 2% increase group 166. Since the intent is to increase optical output power, using the optical output power values for individual LEDs 102 supplied by the manufacturer, the 40% of LEDs 102 having the lowest optical output power values are assigned to the 2% increase group. The same procedure is applied to select groups 172 for other desired increase percentages. The same procedure is applied to select groups 172 for decreasing optical output power for chip 100. Note that the groups can be determined beforehand and stored in memory 134.

It should be understood that the discussion regarding individual LEDs 102 and compensation is applicable to a plurality of groups of LEDs 102, with each group having a separate drive circuit 104.

Figure 10:
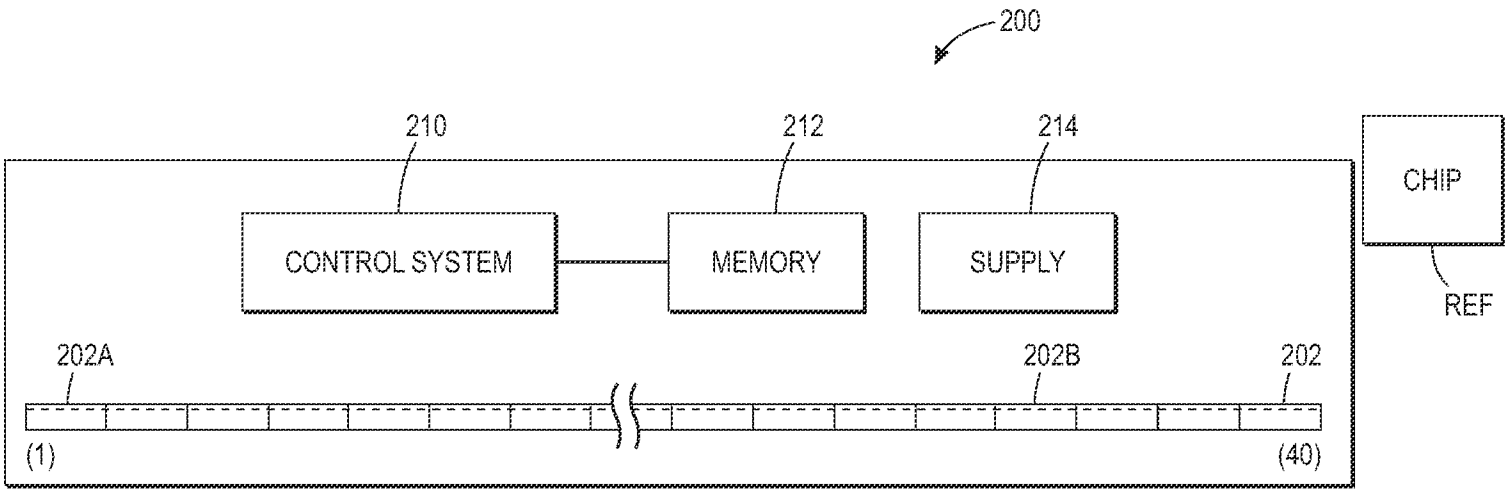
FIG. 10 is a schematic representation of an LPH for a device useful for digital printing, with power compensation.

FIG. 10 is a schematic representation of LPH 200 for a device useful for digital printing, with power compensation. LPH 200 includes semi-conductor chips 202.

Figure 11:
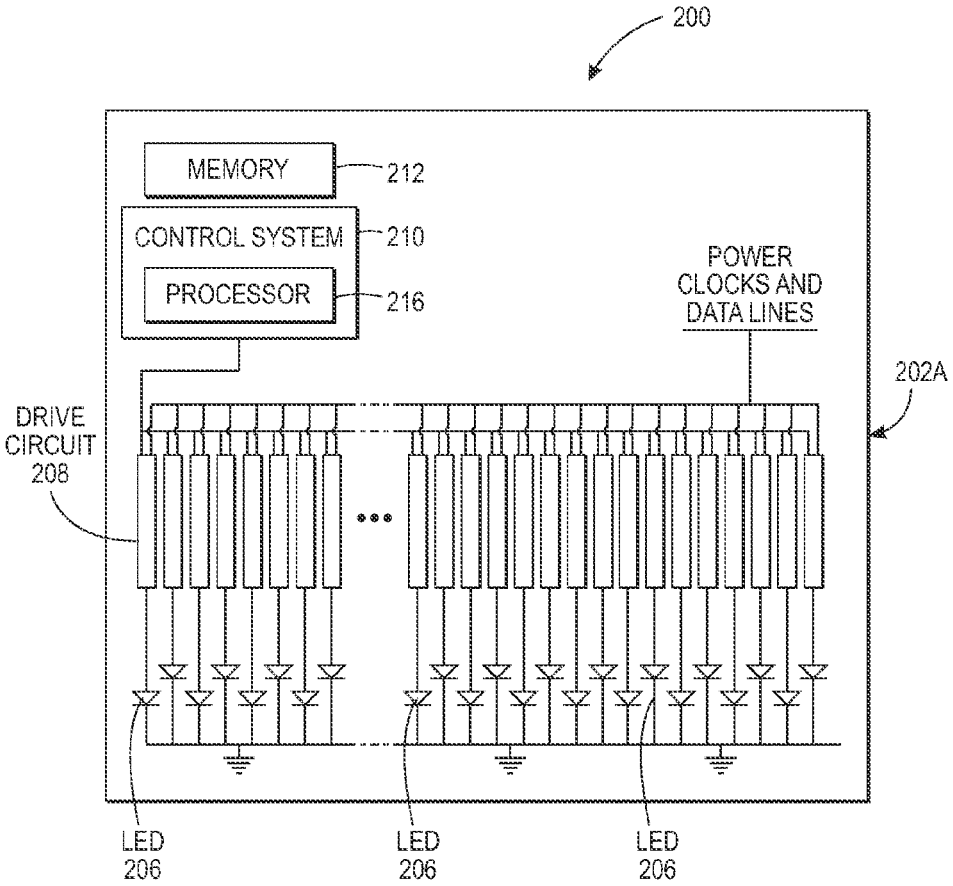
FIG. 11 is a schematic representation of a semi-conductor chip in the LPH of FIG. 10; and, FIG. 12 is a schematic block diagram of a device useful for digital printing including the LPH of FIG. 10.

FIG. 11 is a schematic representation of semi-conductor chip 202A in LPH 200. Each chip 202 includes LEDs 206 and respective drive circuits 208 for each LED 206. Circuits 208 supply electrical power to LEDs 206. LPH 200 includes control system 210 and memory element 212. In an example embodiment, LPH 200 includes power supply 214 used to power LEDs 202. In an example embodiment, control system 210 includes processor 216.

Unless stated otherwise, the discussion regarding chip 100 and LEDs 102 is applicable to chips 202 and LEDs 206. In an example embodiment, the respective compensation described above for chip 100 is implemented on a chip 202 by chip 202 basis using reference chip REF. It should be understood that some or all of chips 202 can be compensated.

In an example embodiment, one of chips 202 acts as the reference (replaces chip REF) for establishing offset 130. For example, chip 202A or chip 202B acts as the reference and the respective compensation described above for chip 100 is implemented on a chip 202 by chip 202 basis using chip 202A or 202B. It should be understood that the positions shown for chips 202A and 202B are for purposes of example only. In an example embodiment, a reference chip 202 is selected according to a criterion related to the optical output power of the reference chip with respect to remaining chips 202. For example, the reference chip could have an optical output power near the average or median of the output powers for all the chips 202. It should be understood that some or all of chips 202 can be compensated.

Figure 12:
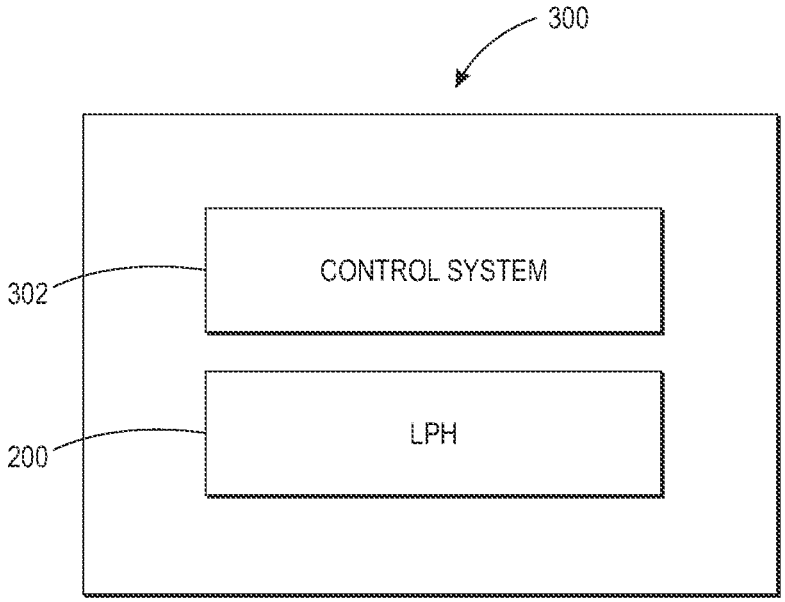

FIG. 12 is a schematic block diagram of device useful for digital printing 300 including LPH 200. The discussion regarding LPH 200 and chip 100 is applicable to device 300. Some or all of the control functions described for control system 214 can be implemented by control system 302.

The following provides further information regarding the compensation described above and should be viewed in light of FIGS. 7 through 12. One goal of the compensation is to account for internal chip strobe (CLKSI) time differences between chip 100 and a reference chip or between multiple chips 202 and a reference chip. The following is directed to a multi-chip application, such as LPH 200. An example of the compensation process can be summarized as follows:

1. The internal strobe time delays of each chip 202, and/or the manifestation of the internal strobe time delays of each chip 202, are identified so that difference 132 is determined between for each chip. This can be done by:
   A. Measuring CLKSI if available or measuring the LED on time or calculate the difference by the average chip power variation between chips at two different strobe times during the initial characterization by the chip supplied at the chip supplier's final set-up and test.
   B. (A) as above on a characterization fixture after receipt from the supplier.
   C. Calculate the difference from the print density variation between chips, using an image sensor, at two different strobe times during the initial set-up in the printing machine.
2. Store offset 130 or master clock differences between chips. This can be in the following way for the above cases:
   A. Along with other stored non-volatile memory values on in memory 212, store the CLKSI differences in maximum allowed frequency clock counts; or in internal correction registers for LED power gain based on strobe length.
   B. Write back chip delay differences into LPH or interface board non-volatile memory during characterization test.
   C. Store required strobe time differences for each chip needed for equal print density in printer memory.
4. Use chip delay data to correct individual chip or LED power or printer toner reproduction curve (which is the toner density versus percent halftone or percent of pixels/LEDs printing) for each pixel in the cross-process direction (item E below). This can be in the following way for the above cases:
   A. Printer software or interface field programmable gate array (logic device that can be programmed for different logic function and memory) read delays for each chip from LPH and writes back new chip/LED correction values to the LPH, as a function of the strobe time setting being used for printing.
   B. LPH internally determines strobe time being used from clock counts and adjust chip/LED power accordingly based on stored chip delay values.
   C. Printer software or interface FPGA read delays for each chip from LPH and writes back new chip/LED correction values to the LPH, as a function of the strobe time setting being used for printing, with the exception of using chip delays from non-volatile memory (NVM) in the interface board, if stored there.

D. Printer software or interface FPGA read delays for each chip from LPH and writes back new chip/LED correction values to the LPH, as a function of the strobe time setting being used for printing, with the exception of using chip delays stored in printer memory.

E. For (A), (C), and (D), the correction can be applied to TRC correction in the cross process direction using the delay information during initial set-up. This is TRC/halftone correction.

Thus, chip 100 and systems 200 and 300, and methods associated with chip 100 and systems 200 and 300 enable LED power correction at the chip or LED level to compensate for internal chip strobe width variation. If an optimized selected subset of LED powers is adjusted, chip power variation due to internal strobe delays can be compensated perfectly at any strobe pulse width for all chips in the LED print head. There is a plurality of methods to detect, store and correct for strobe time variation.

Chip 100 and systems 200 and 300, and methods associated with chip 100 and systems 200 and 300 enable at least the following advantages:

1. No artificially low minimum limit need on LED external clock pulses. As noted above, the greatest variances from calibrated optical power output occurs at relatively shorter external clock pulses. Currently, many manufacturers restrict use of LEDs and LED chips at these shorter clock pulses to avoid the variances noted above. Such restrictions eliminate many desirable printing operations, which require shorter external clock pulses. Thus, a new range of usable external clock pulses and printing operations is enabled.
2. Chip wide streaks can be totally eliminated by correction for even highest quality print applications.
3. In general, existing memory is suitable, as are existing LED calibration NVM locations It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A semi-conductor chip for a print head for a device useful in digital printing, comprising:

a first plurality of light emitting diodes (LEDs);

at least one drive circuit for supplying electrical power to the first plurality of LEDs;

a memory element configured to store an offset; and, a control system:

calibrated to supply, using the at least one drive circuit, the electrical power at a first magnitude to every LED included in the first plurality of LEDs; and, configured to:

receive an external clock pulse;

change using the offset, the first magnitude to at least one second magnitude; and, energize, using the at least one first drive circuit and in response to the external clock pulse, the first plurality of LEDs for an internal strobe time at the at least one second magnitude.

2. A semi-conductor chip for a print head for a device useful in digital printing, comprising:

a first plurality of light emitting diodes (LEDs);

at least one drive circuit for supplying electrical power to the first plurality of LEDs; and, a control system:

calibrated to supply, using the at least one drive circuit, the electrical power at a first magnitude to every LED included in the first plurality of LEDs; and, configured to:

receive a first external clock pulse less than a second external clock pulse used to calibrate the first plurality of LEDs;

change the first magnitude to at least one second magnitude proportional to the first external clock pulse;

receive a third external clock pulse different from the first and second external clock pulses; and, energize, using the at least one first drive circuit and in response to the third external clock pulse, the first plurality of LEDs for a first internal strobe time at the at least one second magnitude calculated by the control system.

3. The semi-conductor chip of claim 2, wherein the control system is configured to:

receive an input including a first optical power output of the first plurality of LEDs energized at the first magnitude in response to the first external clock pulse; and, a second optical power output of a reference chip, including a second plurality of LEDs, energized at the first magnitude in response to the first external clock pulse;

calculate an offset proportional to the first external clock pulse and a difference between the first and second optical power outputs; and, calculate the at least one second magnitude using the offset.

4. The semi-conductor chip of claim 2, further comprising:

a memory element arranged to store an offset proportional to the first external clock pulse and a difference between:

a first optical power output of the first plurality of LEDs energized at the first magnitude in response to the first external clock pulse; and, a second optical power output of a reference chip, including a second plurality of LEDs, energized at the first magnitude in response to the first external clock pulse, wherein:

the control system is configured to calculate the at least one second magnitude using the offset.

5. The semi-conductor chip of claim 2, further comprising:

a memory element arranged to store a lookup table including a plurality of compensating values associated with respective internal strobe times during which the first plurality of LEDs can be energized, each compensating value proportional to a difference between:

a first optical power output of the first plurality of LEDs energized at the first magnitude in response to the first external clock pulse; and, a second optical power output of a reference chip, including a second plurality of LEDs, energized at the first magnitude in response to the first external clock pulse, wherein:

the control system is configured to calculate the at least one second magnitude using a respective compensating value associated with the third external clock pulse.

6. The semi-conductor chip of claim 2, wherein:

the control system is configured to simultaneously energize, using the at least one drive circuit, all LEDs on the semi-conductor chip at a plurality of stepped levels of electrical power;

the at least a portion of the first plurality of LEDs includes all LEDs in the first plurality of LEDs; and, the control system is configured to create the at least one second magnitude by changing the first magnitude by at least one stepped level from the plurality of stepped levels.

7. The semi-conductor chip of claim 2, wherein:

the control system is configured to separately energize, using the at least one drive circuit, each LED on the semi-conductor chip or a plurality of groups forming the first plurality of LEDs, at a plurality of stepped levels of electrical power; and, the control system is configured to create the at least one second magnitude by changing the first magnitude by at least one stepped level from the plurality of stepped levels.

8. The semi-conductor chip of claim 2, wherein:

the control system is configured to:

simultaneously energize, using the at least one drive circuit, all LEDs on the semi-conductor chip at a first plurality of stepped levels of electrical power;

separately energize, using the at least one drive circuit, each LED on the semi-conductor chip or a plurality of groups of LEDs forming the first plurality of LEDs, at second plurality of stepped levels of electrical power;

create a chip-wide magnitude by changing the first magnitude by at least one stepped level from the first plurality of stepped levels;

create an LED magnitude by changing the first magnitude by at least one stepped level from the second plurality of stepped levels;

energize, using the at least one first drive circuit and in response to the third external clock pulse, the first plurality of LEDs for the first internal strobe time at the chip-wide magnitude; and, energize, using the at least one first drive circuit and in response to the third external clock pulse, the at least a portion of the first plurality of LEDs for the first internal strobe time and at the LED magnitude.

9. The semi-conductor chip of claim 2, further comprising:

a memory element, wherein:

the at least one first drive circuit is configured to individually supply electrical power to each LED included in the first plurality of LEDs or to a plurality of groups of LEDs forming the first plurality of LEDs, in stepped levels of magnitude;

each stepped level of magnitude produces a first percentage of optical output power change for said each LED or said each group of LEDs from an average optical output power for the first chip; and, the control system is configured to:

store, in the memory element, a respective optical output power, at the first power level, for said each LED or for said each group of LEDs;

identifying a desired percent change in optical output power for the first plurality of LEDs;

calculate the desired percent change as a percentage of the first percentage;

identify, using the respective optical output powers, a second plurality of LEDs forming a proportion of the first plurality of LEDs equal to the percentage;

change the first magnitude to the at least one second magnitude by an amount of a stepped level; and, energize, using the at least one first drive circuit and in response to the third external clock pulse, the second plurality of LEDs for the first internal strobe time at the at least one second magnitude.

10. The method of claim 2, wherein the first external clock pulse is less than 5 microseconds.

11. The method of claim 2, wherein the second external clock pulse is greater than 25 microseconds.

12. A print head for a device useful in digital printing, comprising:

a first semi-conductor chip including:

a first plurality of light emitting diodes (LEDs); and, at least one first drive circuit for supplying electrical power to the first plurality of LEDs;

a second semi-conductor chip including:

a second plurality of LEDs; and, at least one second drive circuit for supplying electrical power to the second plurality of LEDs; and, a control system:

calibrated to supply, using the at least one power supply and the at least one first and second drive circuits, electrical power at a first magnitude to every LED included in the first and second pluralities of LEDs, respectively; and, configured to:

receive a first external clock pulse less than a second external clock pulse used to calibrate a first plurality of LEDs for the first semi-conductor chip;

change the first magnitude to at least one second magnitude proportional to a duration of the first external clock pulse;

receive a third external clock pulse different from the first and second external clock pulses; and, energize, using the at least one first drive circuit and in response to the third external clock pulse, the first plurality of LEDs for a first internal strobe time at the at least one second magnitude calculated by the control system.

13. The print head of claim 12, wherein the control system is configured to:

receive an input including:

a first optical power output of the first plurality of LEDs energized at the first magnitude in response to the first external clock pulse; and, a second optical power output of the second plurality of LEDs, energized at the first magnitude in response to the first external clock pulse;

calculate an offset proportional to the first external clock pulse and a difference between the first and second optical power outputs; and, calculate the at least one second magnitude using the offset.

14. The print head of claim 12, further comprising:

a memory element arranged to store an offset proportional to the first external clock pulse and a difference between:

a first optical power output of the first plurality of LEDs energized at the first magnitude in response to the first external clock pulse; and, a second optical power output of the second plurality of LEDs energized at the first magnitude in response to the first external clock pulse, wherein:

the control system is configured to calculate the at least one second magnitude using the offset.

15. The print head of claim 12, further comprising:

a memory element arranged to store a lookup table including a plurality of compensating values associated with respective internal strobe times during which the first plurality of LEDs can be energized, each compensating value proportional to a difference between:

a first optical power output of the first plurality of LEDs energized at the first magnitude in response to the first external clock pulse; and, a second optical power output of the second plurality of LEDs energized at the first magnitude in response to the first external clock pulse, wherein:

the control system is configured to calculate the at least one second magnitude using a respective compensating value associated with the third external clock pulse.

16. The print head of claim 12, wherein:

the control system is configured to simultaneously energize, using the at least one power supply and the at least one first drive circuit, all LEDs on the first semi-conductor chip at a plurality of stepped levels of electrical power;

the at least a portion of the first plurality of LEDs includes all LEDs in the first plurality of LEDs; and, the at least one second magnitude includes the first magnitude changed by at least one stepped level from the plurality of stepped levels.

17. The print head of claim 12, wherein:

the control system is configured to energize, using the at least one first drive circuit, each LED on the first semi-conductor chip or each group in a plurality of groups forming the first plurality of LEDs, at a plurality of stepped levels of electrical power; and, the at least one second magnitude includes the first magnitude changed by at least one stepped level from the plurality of stepped levels.

18. The print head of claim 12, wherein:

the control system is configured to:

simultaneously energize, using the at least one drive circuit, all LEDs on the semi-conductor chip at a first plurality of stepped levels of electrical power;

separately energize, using the at least one drive circuit, each LED on the semi-conductor chip or a plurality of groups of LEDs forming the first plurality of LEDs, at second plurality of stepped levels of electrical power;

create a chip-wide magnitude by changing the first magnitude by at least one stepped level from the first plurality of stepped levels;

create an LED magnitude by changing the first magnitude by at least one stepped level from the second plurality of stepped levels;

energize, using the at least one first drive circuit and in response to the third external clock pulse, the first plurality of LEDs for the first internal strobe time at the chip-wide magnitude; and, energize, using the at least one first drive circuit and in response to the third external clock pulse, the at least a portion of the first plurality of LEDs for the first internal strobe time and at the LED magnitude.

19. The print head of claim 12, further comprising:

a memory element, wherein:

the at least one first drive circuit is configured to individually supply electrical power to each LED included in the first plurality of LEDs or to a plurality of groups of LEDs forming the first plurality of LEDs, in stepped levels of magnitude;

each stepped level of magnitude produces a first percentage of optical output power change for said each LED or said each group of LEDs from an average optical output power for the first chip; and, the control system is configured to:

store, in the memory element, a respective optical output power, at the first power level, for said each LED or for said each group of LEDs;

identifying a desired percent change in optical output power for the first plurality of LEDs;

calculate the desired percent change as a percentage of the first percentage;

identify, using the respective optical output powers, a second plurality of LEDs forming a proportion of the first plurality of LEDs equal to the percentage;

change the first magnitude to the at least one second magnitude by an amount of a stepped level; and, energize, using the at least one first drive circuit and in response to the third external clock pulse, the second plurality of LEDs for the first internal strobe time at the at least one second magnitude.

20. A device useful in digital printing, comprising:

a first semi-conductor chip including:

a first plurality of light emitting diodes (LEDs); and, at least one first drive circuit for supplying electrical power to the first plurality of LEDs;

a second semi-conductor chip including:

a second plurality of LEDs; and, at least one second drive circuit for supplying electrical power to the second plurality of LEDs; and, at least one control system:

calibrated to supply, using the at least one power supply and the at least one first and second drive circuits, electrical power at a first magnitude to every LED included in the first and second pluralities of LEDs, respectively; and, configured to:

determine an external clock pulse during which to supply electrical to the first and second pluralities of LEDs at the first magnitude to produce a print output;

change the first magnitude to at least one second magnitude proportional to a duration of the external clock pulse; and, energize, using the at least one first and second drive circuits and in response to the external clock pulse, at least a portion of the first plurality of LEDs and at least a portion of the second plurality of LEDs for an internal strobe time at the at least one second magnitude.

* * * * *